US011143063B2

(12) United States Patent
Lee

(10) Patent No.: US 11,143,063 B2
(45) Date of Patent: Oct. 12, 2021

(54) CYLINDER HEAD AND ENGINE

(71) Applicant: NITTAN VALVE CO., LTD., Hadano (JP)

(72) Inventor: Tai Hwan Lee, Hadano (JP)

(73) Assignee: NITTAN VALVE CO., LTD., Hadano (JP)

( * ) Notice: Subject to any disclaimer, the term of this patent is extended or adjusted under 35 U.S.C. 154(b) by 424 days.

(21) Appl. No.: 16/330,363

(22) PCT Filed: Sep. 2, 2016

(86) PCT No.: PCT/JP2016/075796

§ 371 (c)(1),
(2) Date: Mar. 4, 2019

(87) PCT Pub. No.: WO2018/042620

PCT Pub. Date: Mar. 8, 2018

(65) Prior Publication Data

US 2021/0285345 A1 Sep. 16, 2021

(51) Int. Cl.

| | |
|---|---|
| ***F01L 3/12*** | (2006.01) |
| ***F01P 3/14*** | (2006.01) |
| ***F01L 3/14*** | (2006.01) |

(52) U.S. Cl.

CPC ..... *F01L 3/14* (2013.01); *F01L 2810/01* (2013.01)

(58) Field of Classification Search

CPC ..... F01P 3/14; F01P 7/14; F01L 3/12; F01L 3/14; F01L 5/04

See application file for complete search history.

(56) References Cited

U.S. PATENT DOCUMENTS

| | | | | | |
|---|---|---|---|---|---|
| 3,799,139 | A * | 3/1974 | Kuhn | F01L 3/16 | 123/188.9 |
| 4,450,798 | A * | 5/1984 | Jessel | F01L 3/14 | 123/188.2 |
| 5,458,314 | A * | 10/1995 | Bonesteel | B21D 22/21 | 251/337 |
| 2009/0020082 | A1 * | 1/2009 | Suzuki | F01L 3/14 | 123/41.41 |

FOREIGN PATENT DOCUMENTS

| | | | |
|---|---|---|---|
| JP | 2001-182540 | A | 7/2001 |
| JP | 2006-125277 | A | 5/2006 |
| JP | 2010-094732 | A | 4/2010 |
| WO | 2010/032799 | A1 | 3/2010 |

* cited by examiner

*Primary Examiner* — Long T Tran
(74) *Attorney, Agent, or Firm* — Locke Lord LLP

(57) ABSTRACT

To find compromises in the relationship between the component costs of intake and exhaust valves and the downsizing of an engine and the relationship between the cooling performance and the followability of the intake and exhaust valves and coordinate these conflicting relationships as much as possible. A hollow valve encapsulating coolant having a good cooling function is used as an exhaust valve, which is exposed to a higher temperature environment than an the intake valve, to eliminate a disincentive to downsizing. In contrast, a hollow valve that has no coolant, relatively low component cost, light weight, and good followability is used as the intake valve, which does not need to have a better cooling function than the exhaust valve and needs to have better followability than the exhaust valve to improve combustion efficiency.

20 Claims, 9 Drawing Sheets

CYLINDER HEAD AND ENGINE

TECHNICAL FIELD

The present invention relates to a cylinder head having hollow valves as intake and exhaust valves and an engine having the cylinder head.

BACKGROUND ART

It is said that the technical know-how of hollow valves for aircraft engines has been accumulated since pre-World War II periods, and hollow valves have been generally used for automobile engines such as, for example, high performance engines for racing cars.

There are two advantages in using such hollow valves.

One advantage is that weight reduction provides high followability, thereby contributing to higher revolution of an engine.

Another advantage is that coolant or the like can be charged with therein because of its hollow structure and cooling effects thereof can be expected. Typically, coolant such as metallic sodium has been encapsulated conventionally so as to support higher temperature of a combustion chamber.

Since such hollow valves requires many manufacturing man-hours and expensive, although introduction to high performance engines for automobiles that have a turbocharger or a high compression ratio was performed in relatively early, a barrier hindering introduction to popular cars was relatively high.

However, from a viewpoint of global warming prevention by reduction in carbon dioxide emissions or the like, downsizing of an engine is a global trend in recent years. That is, there is a trend to adopt an engine having a smaller piston displacement than before even in the same type of automobile, make up for shortage of torque associated with a small engine by installing a turbocharger, and improve fuel economy by increasing the compression ratio.

That is, "downsizing of an engine" does not simply mean reduction in the piston displacement. It also means cancelation of the demerit caused by reduction in the piston displacement or prevention of user's feeling of such a demerit by using methods such as installation of a turbocharger or increase in compression ratio.

Accordingly, in recent years when downsizing of an engine has been widely used, combustion temperature is apt to further rise.

Therefore, attention has been focused on hollow valves and popular cars having hollow valves encapsulating coolant are increasing in number. In addition, engines for light cars have started adopting hollow valves charged with a coolant.

Patents concerning techniques for hollow valves are disclosed in, for example, PTL 1 and PTL 2.

PTL 1 is the publication of unexamined patent application applied on Dec. 24, 1999 and discloses the invention in which a hollow valve is used as at least one of an intake valve and an exhaust valve (see paragraph 0009, FIG. 2, and FIG. 4).

Although the intake and exhaust valves are hollow, charge of coolant is not described.

PTL 2 is the publication of unexamined patent application applied on Oct. 28, 2004 and discloses the invention in which hollow valves are used as both an intake valve and an exhaust valve (see paragraph 0029 and FIG. 2).

The intake and exhaust valves in PTL 2 are different from those in PTL 1 in that the valves charged with a coolant including a sodium compound such as sodium potassium.

CITATION LIST

Patent Literature

PTL 1: JP-A-2001-182540
PTL 2: JP-A-2006-125277

SUMMARY OF INVENTION

Technical Problem

A barrier hindering adoption of hollow valves charged with a coolant is its high component cost. Introduction of hollow valves especially those encapsulating coolant to popular cars is not allowed unconditionally because the component cost increases the sales price.

In contrast, in consideration of tendencies to apply a turbocharger because of downsizing of an engine and to increase the compression ratio, the combustion temperature needs to be addressed and introduction of hollow valves charged with a coolant cannot be avoided.

Accordingly, there is a problem in that a trade-off occurs between the component costs of the intake and exhaust valves and the downsizing of an engine.

In addition, there is a second problem with weight reduction of the intake and exhaust valves.

Metallic sodium is often used as coolant to be charged in a valve. The weight of the valve charged with a coolant is larger than in a hollow valve charged with no coolant as a matter of course, thereby weakening friction reduction effects.

Accordingly, there is another trade-off between the cooling performance and weight reduction of the intake and exhaust valves.

There is another problem with reduction in intake efficiency. Coolant is encapsulated in the intake valve to transfer the temperature of the valve head of a valve to the stem. If the temperature of the stem of the intake valve rises, intake air passing through the stem is heated. When intake air is heated, volume efficiency is reduced and combustion efficiency is reduced.

Accordingly, there is another trade-off between the cooling performance and the volume efficiency of the intake valve.

The invention addresses the above problems with the object of finding compromises in the relationship between the costs of the intake and exhaust valves and the downsizing of an engine and the relationship between the cooling performance and followability/volume efficiency of the intake and exhaust valves and coordinating these conflicting relationships as much as possible.

Solution to Problem

To solve the above problem and achieve the above object, according to the invention, there is provided a cylinder head for an internal combustion engine, the cylinder head including an intake valve having a stem and a valve head and an exhaust valve having a stem and a valve head, in which the intake valve is a hollow valve internally having an internal cavity charged with no coolant and the exhaust valve is a hollow valve internally having an internal cavity charged with a coolant.

The balance between performance and cost can be optimized by using a hollow valve charged with a coolant as the exhaust valve and using a hollow valve charged with no coolant as the intake valve.

The intake valve may be a hollow head valve in which the internal cavity is provided in the stem and the valve head. The weight reduction of the intake valve is enabled by using a hollow head valve as the intake valve.

Alternatively, the intake valve may a hollow stem valve in which the internal cavity is provided in the stem. By using a hollow stem valve as the intake valve, reduction in the strength of the intake valve can be prevented particularly in a valve having a large valve head diameter, consequently ensuring reliability in a high combustion pressure engine. In addition, production cost can be reduced.

In addition, the exhaust valve may be a hollow head valve in which the internal cavity is provided in the stem and the valve head. By using a hollow head valve as the exhaust valve charged with a coolant, coolant can circulate through the valve head, thereby ensuring high cooling effects.

Alternatively, the exhaust valve may be a hollow stem valve in which the internal cavity is provided in the stem. By using a hollow stem valve the exhaust valve, production cost can be reduced.

When the valve head of the intake valve is larger than the valve head of the exhaust valve, the length of the internal cavity of the intake valve may be larger than the length of the internal cavity of the exhaust valve or the diameter of internal cavity of the intake valve may be larger than the diameter of the internal cavity of the exhaust valve. It will be appreciated that the length of the internal cavity of the intake valve may be larger than the length of the internal cavity of the exhaust valve and the diameter of the internal cavity of the intake valve may be larger than the diameter of internal cavity of the exhaust valve. The weight difference between the intake valve and the exhaust valve caused by the difference between the sizes of the valve heads can be reduced by changing either or both of the lengths and the diameters of the internal cavities. This can reduce engine friction and improve the fuel economy of the engine.

An engine according to the invention solves the above problem by including a cylinder block that holds a piston in a reciprocally movable manner in a cylinder and rotatably holds a crankshaft that converts a reciprocating motion of the piston to a rotational motion via a connecting rod and the cylinder head according to any one of the first to seventh aspects, the cylinder communicating with a combustion chamber through the cylinder head, the cylinder head being fixed to the cylinder block.

Advantageous Effects of Invention

According to the invention, a hollow valve charged with a coolant having good cooling function is used as the exhaust valve exposed to a higher temperature environment than the intake valve. In contrast, since a hollow valve that has no coolant, the lightest weight, high followability, and low cost is used as the intake valve which is required further followability, it is possible to provide a cylinder head and an engine having good balance between the cooling performance, the followability, and the costs of the intake and exhaust valves.

DESCRIPTION OF EMBODIMENTS

An embodiment will be described with reference to the drawings.

The embodiment is an example of application to the engine having a turbocharger.

The following items will be described.

Figure 1:
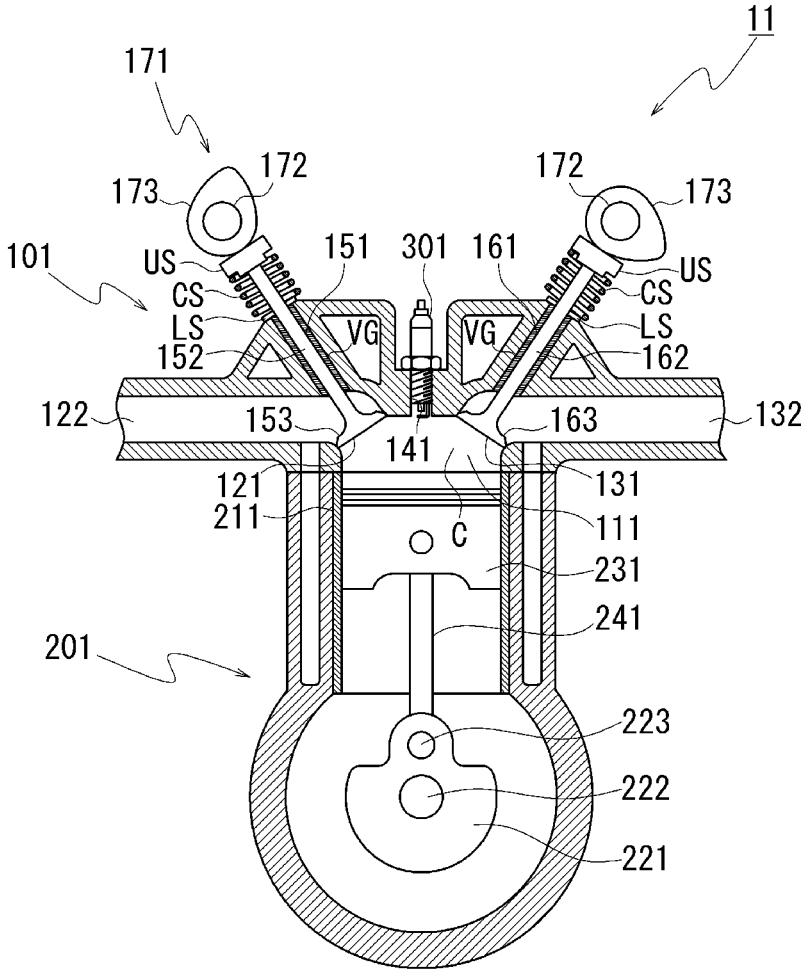
FIG. 1 is longitudinal sectional view illustrating an engine according to an embodiment.

1. Basic structure of the engine
2. Intake and exhaust systems of the engine
3. Structures of the intake valve and the exhaust valve
(1) First form
(2) Second form
(3) Third form
(4) Fourth form
4. Working effect
(1) Relationship between the component costs of the intake and exhaust valves and the downsizing of the engine
(2) Relationship between the cooling performance and the followability of the intake and exhaust valves
5. Modifications 1. Basic Structure of the Engine As illustrated in FIG. 1, an engine 11 includes a cylinder block 201 and a cylinder head 101 mounted thereon.

The cylinder block 201 has a cylinder 211 in an upper part thereof and rotatably holds the crankshaft 221 in a lower part thereof.

The cylinder 211 has a cylindrical shape and slidably houses a piston 231 therein. Accordingly, the piston 231 can perform reciprocating motion while sliding on the inner wall of the cylinder 211 having undergone a smoothing surface process.

The piston 231 as described above is coupled to the crankshaft 221 via a connecting rod 241 so that the reciprocating motion of the piston 231 is converted to the rotational motion of the crankshaft 221 via the connecting rod 241.

The shaft indicated by reference numeral 222 in FIG. 1 is a rotational shaft of the crankshaft 221. In addition, the shaft indicated by reference numeral 223 is a coupling shaft of the crankshaft 221 that is connected to the connecting rod 241.

The cylinder head 101 is coupled to the cylinder block 201 in a position in which the cylinder head 101 faces the cylinder 211 and the piston 231 and a combustion chamber forming region 111 is provided in this coupling part. The combustion chamber forming region 111 is a region that forms a combustion chamber C in the state in which the cylinder head 101 is mounted on the cylinder block 201, and intake and exhaust ports 121 and 131 and a plug hole 141 to which an ignition plug 301 is attached are opened therein.

In FIG. 1, the intake port is indicated by the reference numeral 121 and the exhaust port is indicated by the reference numeral 131. The intake port 121 and the exhaust port 131 are positioned symmetrically with respect to the axial center of the piston 231, the intake port 121 communicates with the intake passage 122, and the exhaust port 131 communicates with the exhaust passage 132.

The plug hole 141 is a threaded hole into which the ignition plug 301 can be screwed and positioned at the axial center of the piston 231.

The cylinder head 101 has intake and exhaust valves 151 and 161.

In FIG. 1, the intake valve is indicated by the reference numeral 151 and the exhaust valve is indicated by the reference numeral 161. The intake valve 151 and the exhaust valve 161 are slidably held by a valve guide VG attached to the cylinder head 101.

The intake and exhaust valves 151 and 161 have a fungiform as a whole in which substantially conical valve heads 153 and 163 are coupled one ends of cylindrical stems 152 and 162. In the following description of this specification, the side close to the stems 152 and 162 of the intake and exhaust valves 151 and 161 is referred to as the upper side and the side close to the valve heads 153 and 163 is referred to as the lower side. The intake and exhaust ports 121 and 131 are opened and closed by the valve heads 153 and 163. In the intake and exhaust valves 151 and 161 as described above, upper sheets US are attached to the rear ends of the stem 152 and 162. In the cylinder head 101, lower sheets LS are formed in positions facing the upper sheet US, and compressed valve springs CS are disposed between the upper sheets US and the lower sheets LS.

Accordingly, when pressing forces are applied to the rear ends, the intake and exhaust valves 151 and 161 slide and move to release the intake and exhaust ports 121 and 131. Since the upper sheets US come close to the lower sheets LS at this time, the valve springs CS are compressed. When the compression forces applied to the rear ends are released, restoring forces of the compressed valve springs CS bias the intake and exhaust valves 151 and 161 and immediately return the valves 151 and 161 to the original positions.

A valve driving mechanism 171 drives the intake and exhaust valves 151 and 161 and opens and closes the intake and exhaust ports 121 and 131.

The valve driving mechanism 171 is built into the cylinder head 101 and mainly includes two camshafts 172 that separately drive the intake and exhaust valves 151 and 161, respectively. These camshafts 172 have cams 173 that apply pressing forces to the rear ends of the intake valve 151 and the exhaust valve 161, respectively, and the rotation of the camshafts 172 causes the cams 173 to drive the intake valve 151 and the exhaust valve 161 at predetermined timings.

This achieves four-cycle operation including "intake" in which only the intake port 121 is opened, "compression" and "combustion" in which both the intake and exhaust ports 121 and 131 are closed, and "exhaust" in which only the exhaust port 131 is opened.

In the processes of such four-cycle operation described above, the valve driving mechanism 171 synchronizes with the rotation of the crankshaft 221 so that "intake" is performed at the timing at which the piston 231 lowers toward the bottom dead center, "compression" is performed at the timing at which the piston 231 having lowered to the bottom dead center rises to the top dead center, "combustion" is performed at the timing at which the piston 231 has risen to the top dead center, and "exhaust" is performed at the timing at which the piston 231 having lowed to the bottom dead center rises toward the top dead center.

Although not illustrated FIG. 1, the cylinder head 101 has a fuel injection device (not illustrated). This fuel injection device sprays gasoline, which is fuel, into the combustion chamber C at the timing of "intake" to generate an air-fuel mixture. Accordingly, the air-fuel mixture including fuel is compressed in the "compression" process and the compressed air-fuel mixture explodes due to fire caused by the ignition plug 301 to perform the "combustion" process.

2. Intake and Exhaust Systems of the Engine

Figure 2:
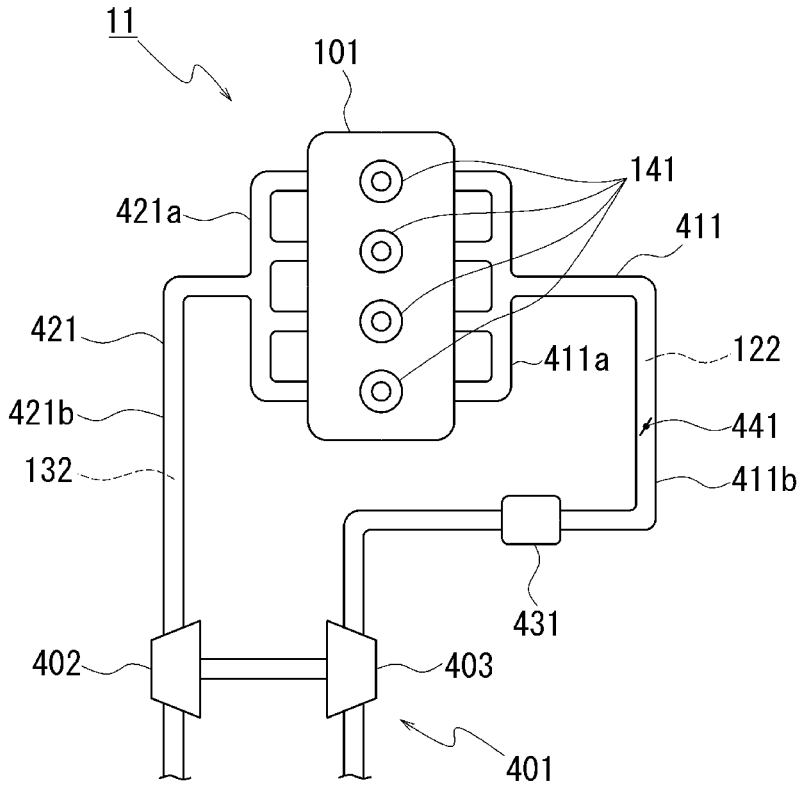
FIG. 2 is a plan view illustrating intake and exhaust systems of the engine including a turbocharger.

As illustrated in FIG. 2, the engine 11 according to the embodiment is a four-cylinder engine and has a turbocharger 401.

That is, an intake manifold 411 branched into four piles that form the intake passages 122 for individual cylinders and an exhaust manifold 421 branched into four pipes that form the exhaust passages 132 for the individual cylinders are connected to the cylinder head 101 of the engine 11. Four pipes 411*a* of the intake manifold 411 are merged to form one collection pipe 411*b* and four pipes 421*a* of the exhaust manifold 421 are merged to form one collection pipe 421*b*.

A turbine 402 of the turbocharger 401 is disposed in the exhaust passage 132 formed by the collection pipe 421*b* of the exhaust manifold 421 merged into one.

A compressor 403 of the turbocharger 401 coupled to the turbine 402 in the same axis is disposed in the intake passage 122 formed by the collection pipe 411*b* of the intake manifold 411 merged into one.

Accordingly, exhaust gas flowing through the exhaust passage 132 rotates the turbine 402 and the compressor 403 thereby rotates at the same speed to compress air. Then, the air-fuel mixture including more oxygen is fed into the combustion chamber C in the "intake" process to improve the combustion efficiency in the "combustion" process.

In the supercharge process by the turbocharger 401 as described above, the temperature of air flowing through the intake passage 122 is raised by compression by the compressor 403. This easily causes nocking due to the air-fuel mixture captured in the cylinder 211 in the "intake" process. Accordingly, in the embodiment, an intercooler 431 is provided between the compressor 403 and the branch pipes 411*a* to lower the temperature of air flowing through the intake passage 122.

In addition, a throttle valve 441 is provided downstream of the intercooler 431 in the intake passage 122 so that the flowrate of air flowing through the intake passage 122 can be adjusted.

It will be appreciated that the structures of the above cylinder head and other engine parts are examples and the structures of the intake and exhaust valves described later, which are features of the invention, are widely applicable to a cylinder head of an internal combustion engine or an engine.

3. Structures of the Intake Valve and the Exhaust Valve

In the embodiment, hollow valves are used as the intake valve 151 and the exhaust valve 161. A hollow valve internally has a internal cavity H.

Although both the intake valve 151 and the exhaust valve 161 have hollow valves, these valves have different structures.

Figure 3:
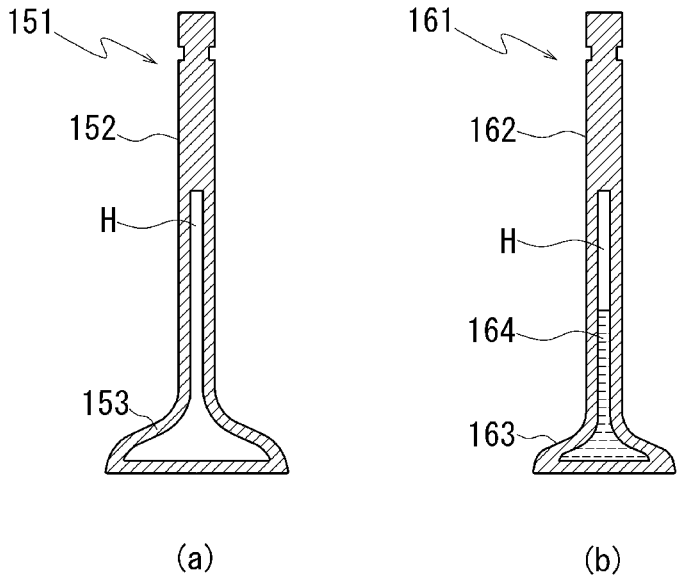
FIG. 3(*a*) is a longitudinal cross sectional front view illustrating an intake valve and FIG. 3(*b*) is a longitudinal cross sectional front view illustrating an exhaust valve in a first form of a combination of the intake and exhaust valves.
Figure 6:
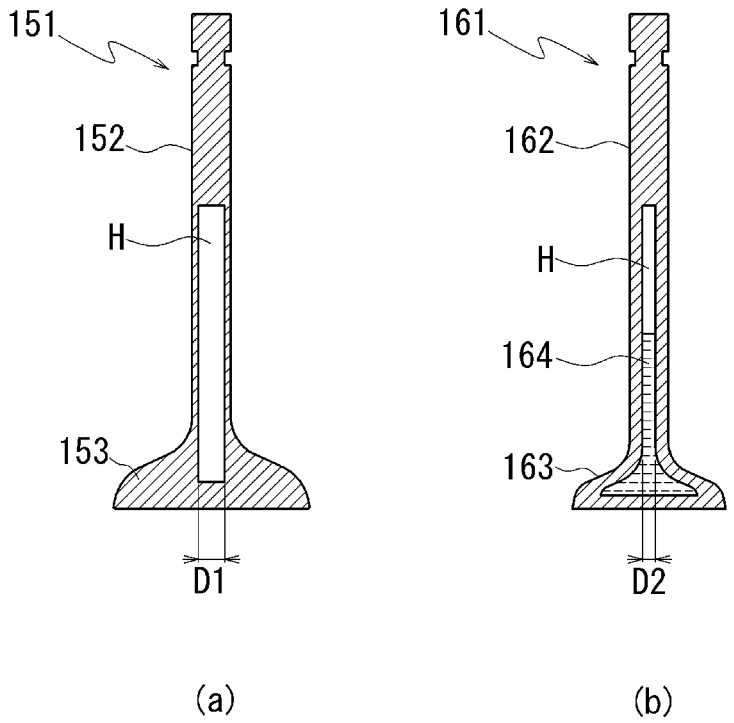
FIG. 6(*a*) is a longitudinal cross sectional front view illustrating an intake valve and FIG. 6(*b*) is a longitudinal cross sectional front view illustrating an exhaust valve in a fourth form of the combination of the intake and exhaust valves.
Figure 7:
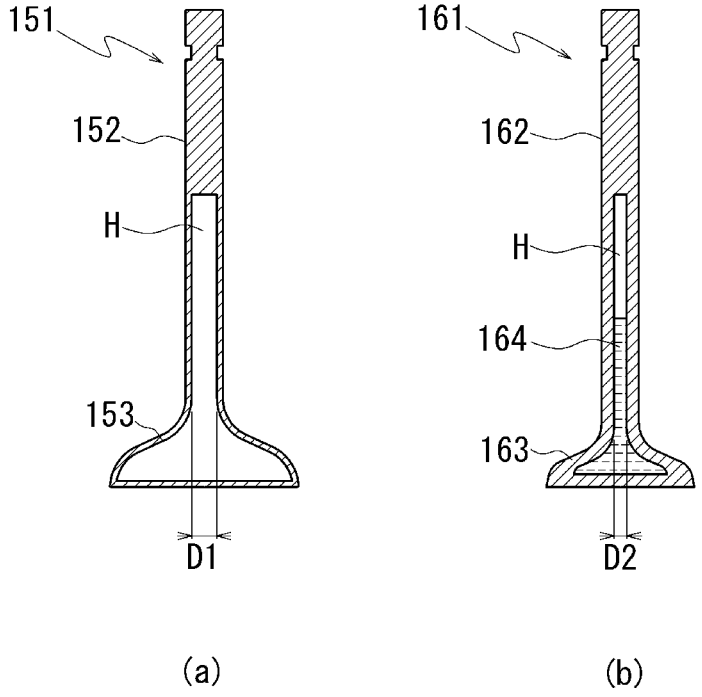
FIG. 7(*a*) is a longitudinal cross sectional front view illustrating an intake valve and FIG. 7(*b*) is a longitudinal cross sectional front view illustrating an exhaust valve in a modification of the combination of the intake and exhaust valves.

FIGS. 3(*a*) and 3(*b*) to FIGS. 6(*a*) and 6(*b*) illustrate four examples (first to fourth forms) of the combination of the intake valve 151 and the exhaust valve 161 that can be adopted in the embodiment.

(1) First Form

As illustrated in FIG. 3(*a*), the internal cavity H of the intake valve 151 is formed as one continuous space extending from the vicinity of the middle of the stem 152 to the valve head 153. As illustrated, a valve in which not only the stem, but also the valve head is hollow is referred to below as a "hollow head valve". When the valve head is also hollow, the weight of the intake valve 151 can be further reduced and engine friction can be reduced. The intake valve 151, which is a hollow head valve, charged with no coolant.

Since the process for charging with a coolant in the intake valve is not present as described above, low cost and high performance can be achieved. If the intake valve 151 charged with a coolant, the heat of the valve head 153 is transferred to the stem 152 via coolant and the temperature of the stem 152 may rise. Since no coolant is charged, it is possible to prevent the temperature of intake air from rising due to a rise in the temperature of the stem 152 and prevent reduction in the combustion efficiency.

As illustrated in FIG. 3(*b*), the exhaust valve 161 is a hollow head valve having the internal cavity H not only in the stem 162, but also in the valve head 163. Furthermore, the internal cavity H charged with a coolant 164. For example, metallic sodium is used as the coolant 164. Since the exhaust valve 161 is a hollow head valve, the coolant 164 circulates through the valve head 163 and high cooling effects can be obtained. Since the temperature of the bottom surface of the exhaust valve 161 is lowered by the coolant 164, the intake efficiency can be improved, nock limit can be extended, and preignition can be prevented. In addition, since the temperatures of the valve head 163 and the stem 164 are lowered, the safety ratio in material strength can be improved. As a result, a light and inexpensive valve steel material can be used, thereby improving economical efficiency.

(2) Second Form

Figure 4:
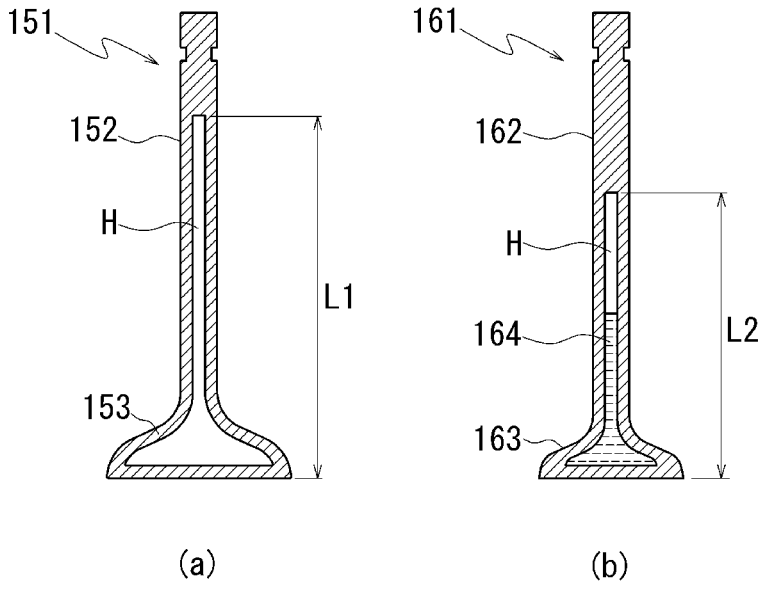
FIG. 4(*a*) is a longitudinal cross sectional front view illustrating an intake valve and FIG. 4(*b*) is a longitudinal cross sectional front view illustrating an exhaust valve in a second form of the combination of the intake and exhaust valves.

In the second form, as illustrated in FIG. 4(*a*), the intake valve 151 is a hollow head valve having the internal cavity H charged with no coolant as in the first form. In addition, as illustrated in FIG. 4(*b*), the exhaust valve 161 is a hollow head valve having the internal cavity H also in the valve head 163 and the internal cavity H of the exhaust valve 161 charged with a coolant 164.

As illustrated in FIG. 4, the valve head 153 of the intake valve 151 is normally larger than the valve head 163 of the exhaust valve 161. Accordingly, when the internal cavities H of both valves have the same size as illustrated in FIG. 3, the intake valve 151 is heavier than the exhaust valve 161. The exhaust valve 161 charged with the coolant 164 and the specific gravity of coolant 161 is normally smaller than in the valve steel material. For example, the specific gravity of metallic sodium is about one-eighth of that of valve steel material. Accordingly, even if the weight of the coolant 164 is added, the intake valve 151 is normally heavier than the exhaust valve 161.

As described above, the intake valve 151 and the exhaust valve 161 are biased by the valve springs CS and kept in the closed state. Accordingly, the valve spring CS needs to be designed to generate a reaction force proportional to the weight of the valve. Normally, the valve spring CS common to the intake valve 151 and the exhaust valve 161 is used to reduce the production cost of the component. Accordingly, the valve spring CS is designed so as to correspond to the intake valve 151 having a heavier weight. If the weight difference with the exhaust valve 161 is reduced by weight reduction of the intake valve 151, the reaction force of the valve spring CS can be reduced. As a result, engine friction can be reduced and the fuel economy of the engine can be improved.

Therefore, as illustrated in FIG. 4, a length L1 of the internal cavity H of the intake valve 151 is set to a value larger than a length L2 of the internal cavity H of the exhaust valve 161. Here, "the length of the internal cavity" means the length from the lower end of the intake valve 151 or the exhaust valve 161 to the upper end of the internal cavity H. If the internal cavity H of the intake valve 151 is extended as described above, the volume of the internal cavity H is increased, thereby reducing the amount of valve steel material. Accordingly, the weight difference with the exhaust valve 161 can be reduced by weight reduction of the intake valve 151. Since the length L1 and the length L2 are not limited to particular values, they can be set to appropriate values so that the weight difference between the intake valve 151 and the exhaust valve 161 is reduced or the weights of these valves are identical.

(3) Third Form

Figure 5:
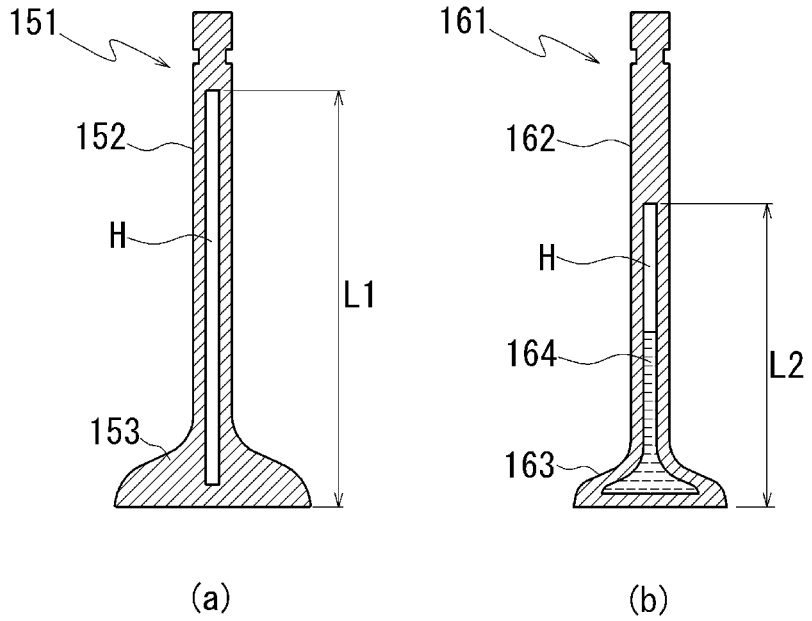
FIG. 5(*a*) is a longitudinal cross sectional front view illustrating an intake valve and FIG. 5(*b*) is a longitudinal cross sectional front view illustrating an exhaust valve in a third form of the combination of the intake and exhaust valves.

In the third form, as illustrated in FIG. 5(*b*), the exhaust valve 161 is a hollow head valve having the internal cavity H not only in the stem 162, but also in the valve head 163 as in the first and second forms and charged with the coolant 164 therein.

In addition, in the third form, the intake valve 151 has the internal cavity H only in the stem 152 and the valve head 153 is solid as illustrated in FIG. 5(*a*). A valve having the internal cavity H only in the stem 152 as described above is referred to as a "hollow stem valve".

In a high combustion pressure engine, particularly in the case of a hollow head valve having a large valve head diameter, when a hollow head valve is used as the intake valve, the bottom surface may be bowed. Accordingly, when a hollow stem valve is used as the intake valve 151 consciously, reliability can be obtained by preventing reduction in strength. In addition, when a hollow stem valve is used, the production cost can be reduced.

In contrast, since the valve head of a hollow stem valve is solid, a hollow stem valve is heavier than a hollow head valve. Since the exhaust valve 161 is a hollow head valve in the third form, the weight difference between both valves is larger than in the second form. Therefore, when the length of an internal cavity L1 of the intake valve 151 becomes further larger than in the second form as illustrated in FIG. 5, the weight of the intake valve 151 can be further reduced and the weight difference with the exhaust valve 161 can be reduced. This can reduce engine friction and improve the fuel economy of the engine as in the second form.

(4) Fourth Form

As illustrated in FIG. 6(*a*), the intake valve 151 is a hollow stem valve having the internal cavity H only in the stem 152 as in the third form.

As illustrated in FIG. 6(*b*), the exhaust valve 161 in the fourth form is the same as the exhaust valves 161 in the first to third forms. That is, the exhaust valve 161 in the fourth form is a hollow head valve having the internal cavity H not only in the stem 162, but also in the valve head 163 and charged with the coolant 164 therein.

In the fourth form, the internal cavities Hof the intake valve 151 and the exhaust valve 161 have the same length and a diameter D1 of the internal cavity H of the intake valve 151 is larger than a diameter D2 of the internal cavity of the exhaust valve 161. When the diameter D1 of the internal cavity H of the intake valve 151 is increased, the volume of the internal cavity H is increased and the amount of valve steel material is reduced by that volume. This can reduce the weight difference between the intake valve 151 and the exhaust valve 161 by weight reduction of the intake valve 151 as in the second and third forms. As a result, engine friction can be reduced and the fuel economy of the engine can be improved. It should be noted here that "the diameter of the internal cavity" means the diameter of the stem of the internal cavity. Since the diameter D1 and the diameter D2 are not limited to particular values, they can be set to appropriate values so that the weight difference between the intake valve 151 and the exhaust valve 161 is reduced or the weights of these valves are identical.

4. Working Effect

Since the working effects of the engine 11 and the turbocharger 401 have been simply described above, detailed descriptions are omitted.

Here, the working effects of the intake and exhaust valves 151 and 161 will be described.

(1) Relationship Between the Component Costs of the Intake and Exhaust Valves and the Downsizing of the Engine Adoption of a hollow valve charged with the coolant is preferable to achieve the downsizing of the engine as described above and it is necessary in some cases.

However, since a hollow valve charged with the coolant is much more expensive in component cost than that of a solid valve, such a hollow valve cannot be unconditionally adopted regardless of the type and grade of a vehicle.

Accordingly, optimum combinations of the intake and exhaust valves 151 and 161 are proposed in the embodiment.

First, when attention is focused on the difference between environments to which the intake valve 151 and the exhaust valve 161 are exposed, severer heat measures need to betaken for the exhaust valve 161. This is because the exhaust valve 161 is exposed to a higher temperature environment to introduce combustion gas heated by combustion from the exhaust port 131 to the exhaust passage 132 than the intake valve 151, which only needs to capture outside air from the intake port 121 to the cylinder 211.

Therefor, in the embodiment, as described above first form to third form a hollow valve charged with the coolant is used as the exhaust valve 161 and a hollow valve charged with no coolant is used as the intake valve 151.

This can coordinate these conflicting relationships between the component costs of the intake and exhaust valves 151 and 161 and the downsizing of the engine 11 as much as possible.

(2) Relationship Between the Cooling Performance and the Followability of the Intake and Exhaust Valves The improvement of combustion efficiency in the combustion chamber C and the higher revolution of the engine are significantly effected by the followability of the intake and exhaust valves 151 and 161.

For example, when the followability of the intake valve 151 is poor, the amount of air-fuel mixture that can be introduced into the cylinder 211 in the "intake" process fluctuates. This is because the maximum amount of air-fuel mixture may not be introduced to the cylinder 211 or the introduced air-fuel mixture may be returned through the intake port 121 when the followability of the intake valve 151 is poor.

Similarly, when the followability of the exhaust valve 161 is poor, there is a problem in that gas resulting from combustion remains in the combustion chamber C.

Therefore, in the embodiment, hollow valves are adopted as the intake and exhaust valves 151 and 161 to improve the followability.

Since a hollow valve charged with no coolant 164 is used especially for the intake valve 151, further improvement of the followability can be expected.

5. Modifications

Although an embodiment of the invention has been described above, various omissions, replacements, and changes can be made without departing from the spirit of the invention. The above embodiment and the modifications thereof are included in the scope and spirit of the invention and included in the invention designated in the appended claims and the equivalent scope.

For example, although the examples (the second and third forms described above) in which the length L1 of the internal cavity H of the intake valve 151 is larger than the length L2 of the internal cavity H of the exhaust valve 161 and the example (the fourth form described above) in which the diameter D1 of the internal cavity H of the intake valve 151 is larger than the diameter D2 of the internal cavity H of the exhaust valve 161 are illustrated in the above embodiment, these two means may be used together in practice.

In addition, although the example in which a hollow stem valve is used as the intake valve 151 is illustrated in the fourth form, a hollow head valve may be used as the intake valve 151 and the diameter D1 of the internal cavity H may be larger than the diameter D2 of the internal cavity H of the exhaust valve 161.

Figure 8:
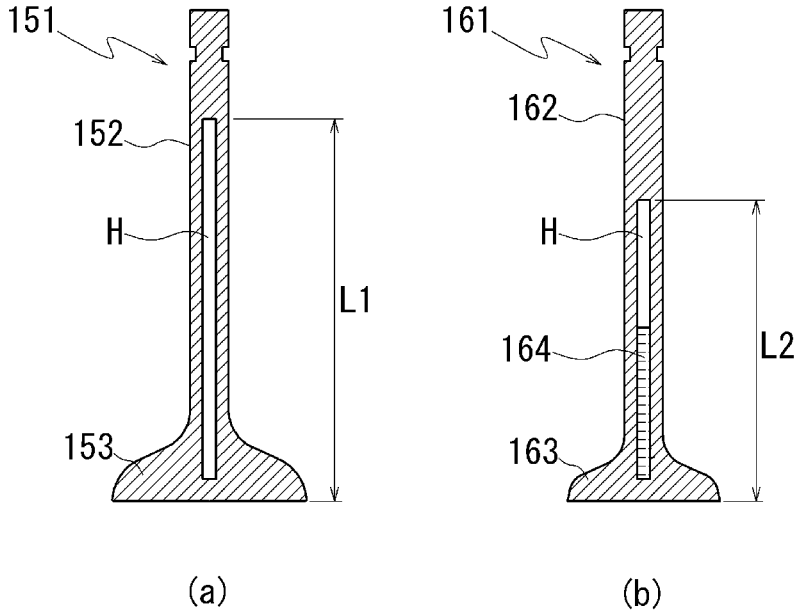
FIG. 8(*a*) is a longitudinal cross sectional front view illustrating an intake valve and FIG. 8(*b*) is a longitudinal cross sectional front view illustrating an exhaust valve in another modification of the combination of the intake and exhaust valves.
Figure 9:
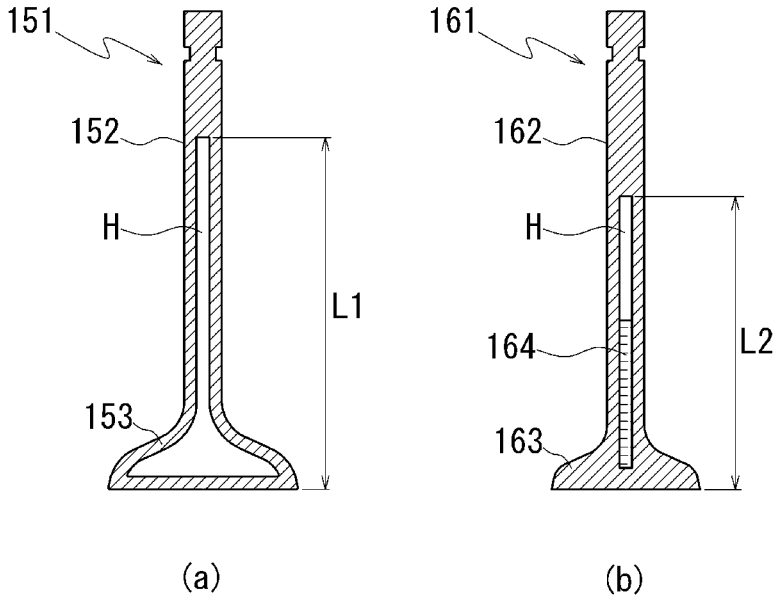
FIG. 9(*a*) is a longitudinal cross sectional front view illustrating an intake valve and FIG. 9(*b*) is a longitudinal cross sectional front view illustrating an exhaust valve in still another modification of the combination of the intake and exhaust valves.

In addition, a hollow head valves are used as the exhaust valves 161 in the above forms as an example. However, a hollow stem valve may be used as the exhaust valve 161 as illustrated in FIG. 8(*b*) and FIG. 9(*b*). By using a hollow stem valve as the exhaust valve 161, the production cost can be reduced. In this case, a hollow stem valve may be used as the intake valve 151 as illustrated in FIG. 8(*a*) or a hollow head valve may be used as illustrated in FIG. 9(*a*). In the cases of FIG. 8 and FIG. 9, when there is a weight difference between the intake valve 151 and the exhaust valve 161, this weight difference may be reduced by making the length L1 of the internal cavity H of the intake valve 151 larger than the length L2 of the internal cavity H of the exhaust valve 161 or making the diameter D1 larger than the diameter D2.

Although the intake valve 151 is normally heavier than the exhaust valve 161 as described above, if the exhaust valve 161 is heavier than the intake valve 151, the length L2 of the internal cavity H of the exhaust valve 161 may be larger than the length L1 of the internal cavity H of the intake valve 151 or the diameter D2 may be larger than the diameter D1.

Any other modifications and changes are allowed.

REFERENCE SIGNS LIST

111: combustion chamber forming region
121: intake port
131: exhaust port
151: intake valve
161: exhaust valve
171: valve driving mechanism
201: cylinder block
211: cylinder
221: crankshaft
231: piston
241: connecting rod
C: combustion chamber
H: internal cavity

The invention claimed is:

1. A cylinder head for an internal combustion engine, the cylinder head comprising:
an intake valve having a stem and a valve head; and
an exhaust valve having a stem and a valve head,
wherein the intake valve is a hollow valve internally having an internal cavity charged with no coolant and
the exhaust valve is a hollow valve internally having an internal cavity charged with a coolant.

2. The cylinder head according to claim 1,
wherein the intake valve is a hollow head valve in which the internal cavity is provided in the stem and the valve head.

3. The cylinder head according to claim 2,
wherein the exhaust valve is a hollow head valve in which the internal cavity is provided in the stem and the valve head.

4. The cylinder head according to claim 3,
wherein the diameter of the valve head of the intake valve is larger than the diameter of the valve head of the exhaust valve and the length of the internal cavity of the intake valve is larger than the length of the internal cavity of the exhaust valve.

5. The cylinder head according to claim 3,
wherein the diameter of the valve head of the intake valve is larger than the diameter of the valve head of the exhaust valve and the diameter of the internal cavity of the intake valve is larger than the diameter of the internal cavity of the exhaust valve.

6. An engine comprising:
a cylinder block that holds a piston in a reciprocally movable manner in a cylinder and rotatably holds a crankshaft that converts a reciprocating motion of the piston to a rotational motion via a connecting rod; and
the cylinder head according to claim 3, the cylinder communicating with a combustion chamber through the cylinder head, the cylinder head being fixed to the cylinder block.

7. The cylinder head according to claim 2,
wherein the exhaust valve is a hollow stem valve in which the internal cavity is provided in the stem.

8. The cylinder head according to claim 7,
wherein the diameter of the valve head of the intake valve is larger than the diameter of the valve head of the exhaust valve and the length of the internal cavity of the intake valve is larger than the length of the internal cavity of the exhaust valve.

9. The cylinder head according to claim 2,
wherein the diameter of the valve head of the intake valve is larger than the diameter of the valve head of the exhaust valve and the length of the internal cavity of the intake valve is larger than the length of the internal cavity of the exhaust valve.

10. The cylinder head according to claim 2,
wherein the diameter of the valve head of the intake valve is larger than the diameter of the valve head of the exhaust valve and the diameter of the internal cavity of the intake valve is larger than the diameter of the internal cavity of the exhaust valve.

11. An engine comprising:
a cylinder block that holds a piston in a reciprocally movable manner in a cylinder and rotatably holds a crankshaft that converts a reciprocating motion of the piston to a rotational motion via a connecting rod; and
the cylinder head according to claim 2, the cylinder communicating with a combustion chamber through the cylinder head, the cylinder head being fixed to the cylinder block.

12. The cylinder head according to claim 1,
wherein the intake valve is a hollow stem valve in which the internal cavity is provided in the stem.

13. The cylinder head according to claim 12,
wherein the exhaust valve is a hollow head valve in which the internal cavity is provided in the stem and the valve head.

14. The cylinder head according to claim 12,
wherein the exhaust valve is a hollow stem valve in which the internal cavity is provided in the stem.

15. The cylinder head according to claim 12
wherein the diameter of the valve head of the intake valve is larger than the diameter of the valve head of the exhaust valve and the length of the internal cavity of the intake valve is larger than the length of the internal cavity of the exhaust valve.

16. The cylinder head according to claim 12,
wherein the diameter of the valve head of the intake valve is larger than the diameter of the valve head of the exhaust valve and the diameter of the internal cavity of the intake valve is larger than the diameter of the internal cavity of the exhaust valve.

17. An engine comprising:
a cylinder block that holds a piston in a reciprocally movable manner in a cylinder and rotatably holds a crankshaft that converts a reciprocating motion of the piston to a rotational motion via a connecting rod; and
the cylinder head according to claim 12, the cylinder communicating with a combustion chamber through the cylinder head, the cylinder head being fixed to the cylinder block.

18. The cylinder head according to claim 1,
wherein the diameter of the valve head of the intake valve is larger than the diameter of the valve head of the exhaust valve and the length of the internal cavity of the intake valve is larger than the length of the internal cavity of the exhaust valve.

19. The cylinder head according to claim 1,
wherein the diameter of the valve head of the intake valve is larger than the diameter of the valve head of the exhaust valve and the diameter of the internal cavity of the intake valve is larger than the diameter of the internal cavity of the exhaust valve.

20. An engine comprising:
a cylinder block that holds a piston in a reciprocally movable manner in a cylinder and rotatably holds a crankshaft that converts a reciprocating motion of the piston to a rotational motion via a connecting rod; and the cylinder head according to claim 1, the cylinder communicating with a combustion chamber through the cylinder head, the cylinder head being fixed to the cylinder block.

* * * * *